US005495669A

United States Patent [19]

Legrady et al.

[11] Patent Number: 5,495,669

[45] Date of Patent: Mar. 5, 1996

[54] METHOD OF MAKING BOX CONTACTS

[75] Inventors: Janos Legrady, Putnam Valley; William S. Searles, Monroe, both of N.Y.

[73] Assignee: Zierick Manufacturing Corp., Mt. Kisco, N.Y.

[21] Appl. No.: 349,975

[22] Filed: Dec. 6, 1994

Related U.S. Application Data

[62] Division of Ser. No. 124,977, Sep. 21, 1993.

[51] Int. Cl.[6] ..... H01R 43/00

[52] U.S. Cl. ..... 29/885; 29/883; 29/884; 439/730

[58] Field of Search ..... 29/884, 883, 852, 29/825, 885; 439/730, 876

[56] References Cited

U.S. PATENT DOCUMENTS

| | | | |
|---|---|---|---|
| 3,650,706 | 3/1972 | Parsons | 29/829 X |
| 4,149,768 | 4/1979 | Wise | 439/730 |
| 4,241,976 | 12/1980 | Oliver et al. | 29/883 X |
| 5,073,132 | 12/1991 | Nottrott | 29/884 X |
| 5,175,928 | 1/1993 | Grabbe | 29/884 |
| 5,274,911 | 1/1994 | Toro | 29/884 X |

*Primary Examiner*—Carl Arbes

*Attorney, Agent, or Firm*—Lackenbach Siegel Marzullo Aronson & Greenspan

[57] ABSTRACT

A box contact is disclosed which is coated on the interior surface thereof proximate to the lower open end as well as on the upper ends of the mounting legs with a solder-resistant tape to prevent solder from wicking into and blocking the lower open end of the contact portion. The method of producing such anti-wicking box contacts is also described.

2 Claims, 3 Drawing Sheets

METHOD OF MAKING BOX CONTACTS

CROSS-REFERENCE TO RELATED APPLICATION

Divisional application of Ser. No. 08/124,977 filed on Sep. 21, 1993.

BACKGROUND OF THE INVENTION

This invention generally relates to electrical connectors, and more specifically to a box contact for mounting on a printed circuit board which eliminates wicking during wave soldering, and method of manufacturing the electrical contact.

Box contacts that have substantially box shaped upper contact portions and downwardly extending mounting legs intended to pass through openings or holes in printed circuit boards are well-known and extensively used and have for many applications. Such box contacts generally have relatively large interior spaces into which there typically project a plurality of spring contacts intended to resiliently engage a male contact member inserted into the box contact. However, prior art designs require manual masking in order to prevent the entry of solder into the lower openings of the box contacts during wave soldering. The entry of the solder through the bottom opening of the box contact and subsequent hardening of the solder have presented problems since the solder interferes with the full insertion of the male contact and, additionally, may interfere with and in some cases substantially eliminate the resilient properties of the spring fingers or contacts.

Referring to FIG. 1, a conventional box contact of the type under discussion is generally designated by the reference numeral 10. The contact has an upper portion 10*a* which generally has a rectangular substantially uniform cross-section defining an interior space 11 as shown. Spring contacts or fingers 10*b* extend into the interior space of the box contact 10. Mounting legs 10*c* depend from the upper box portion 10*a*, with a small portion 10*d* of the mounting legs protruding beyond the printed circuit board 12. The protruding portions 10*d* are the portions of the mounting legs generally soldered to the lands or soldering pads (not shown) on the lower surface of the printed circuit board. Shown in dashed outline and designated by the letter S is a peak of molten solder which propagates through a wave-soldering machine in waves, as is well-known to those skilled in the art. In order to prevent the solder from entering through the lower open end of the box connector, a plug P or other masking scheme is commonly used. After wave-soldering, the solder mask or the plugs have to be removed.

Referring to FIG. 2, Zierick Manufacturing Corporation, the assignee of the present application, developed a box contact to eliminate masking and plugging of the holes useful for some wave-soldering applications. By selecting relative dimensions shown in FIG. 2, wherein the box B above the printed circuit board has dimensions greater than the dimensions of the aperture or hole 14 in the printed circuit board. Only relatively small mounting legs 10*c* extend through the hole so as to provide minimal metal within the area of the printed circuit board hole. Tests show and production runs confirm that this design prevents solder wicking if a standard wave soldering machine is used. However, with the introduction of surface mount technology, there are new turbulent wave-soldering machines for which the design suggested in FIG. 2 is not adequate.

Circuit board sockets have been disclosed for addressing this problem. For example, in U.S. Pat. No. 3,864,004, a socket is disclosed which has an inner surface of the body solder-resistant to prevent solder from flooding into the socket. However, in order to prevent solder from flooding and remaining in the socket, a solder-resist is used, such as a resistant aluminum oxide coating. The patent also suggests other alternative solder resists, such as chrome plate and a number of other commercially available resists. However, the use of solder resists that must be plated or deposited on a selected surface entails additional steps in the manufacturing process and this complicates the manufacturing process and makes the terminals more costly to manufacture. A pin and socket connector assembly utilizing a similar solder resist approach is disclosed in U.S. Pat. No. 3,222,632, and a circular board eyelet also utilizing a solder resist layer is disclosed in U.S. Pat. No. 4,070,077.

SUMMARY OF THE INVENTION

Accordingly, it is an object of the present invention to provide a box contact that eliminates solder wicking and which does not have the disadvantages inherent in comparable prior art contacts.

It is another object of the present invention to provide an anti-wicking box contact which is simple in construction and economical to manufacture.

It is another object of the present invention to provide a box contact of the type aforementioned which can be formed as a plurality of like box contacts detachably mounted on an elongate carrier.

It is yet another object of the present invention to provide a box contact as suggested in the previous objects which substantially simplifies the manufacture of an anti-wicking box contact and which optimizes the production thereof.

It is a further object of the present invention to provide a method of manufacturing box contacts of the type outlined in the previous objects.

In order to achieve the above objects, as well as others which will become apparent hereafter, a box contact for mounting on a printed circuit board having an opening comprises a contact portion having a general uniform rectangular cross-section forming an interior space open at upper and lower ends of said contact portion for receiving a male contact member through the upper end and mounting legs, at said lower open end, spaced to be receivable through the opening in the printed circuit board. A solder-resistant tape is adhesively attached to a surface of said contact portion within said interior space at least in the region of said lower open end. Said tape is resistive to molten solder to thereby mask said surface and prevent solder from wicking into and blocking said lower open end of said contact portion.

In accordance with the method of the present invention, a continuous strip of metallic material is advanced along a predetermined path. Said strip of metallic material has a predetermined width and is provided with a solderable surface and defines first and second longitudinal edges. A continuous strip of solder-resistant tape is advanced along said predetermined path and juxtaposed with said strip of metallic material. Said strip of tape has a width smaller than said predetermined width and is provided with adhesive on a side facing said strip of metallic material. Said strip of tape is attached to said metallic strip to cover a first continuous longitudinal surface portion of said metallic strip proximate to said first longitudinal edge to thereby leave exposed a second continuous longitudinal surface portion of said metallic strip proximate to said second longitudinal edge. Said attached strips are die cut and formed to form the upper portions of the box contacts detachably connected to a continuous carrier strip formed from said second longitudinal surface portion and lower portions of box contacts and mounting legs for each box contact from said second continuous longitudinal surface portion. In this manner, said lower portions of the box contacts and legs are at least partially covered with said solder-resistant tape to prevent wicking into and blocking a lower open end of the box contact.

BRIEF DESCRIPTION OF THE DRAWINGS

Other objects and features of the invention will become apparent from the description that follows, taken in conjunction with the accompanying drawings illustrating the invention, in which.

DESCRIPTION OF THE PREFERRED EMBODIMENTS

Figure 1:
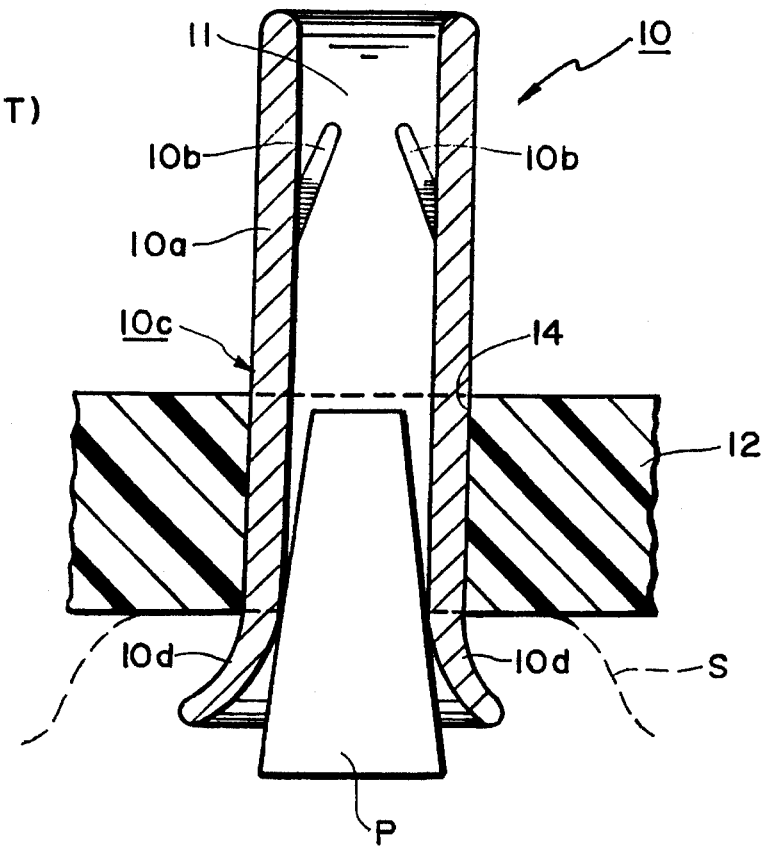
FIG. 1 (PRIOR ART)
FIG. 1 is a cross-sectional view of a prior art box contact mounted on a printed circuit board (PCB) and having its lower open end closed by a plug during wave soldering.
Figure 2:
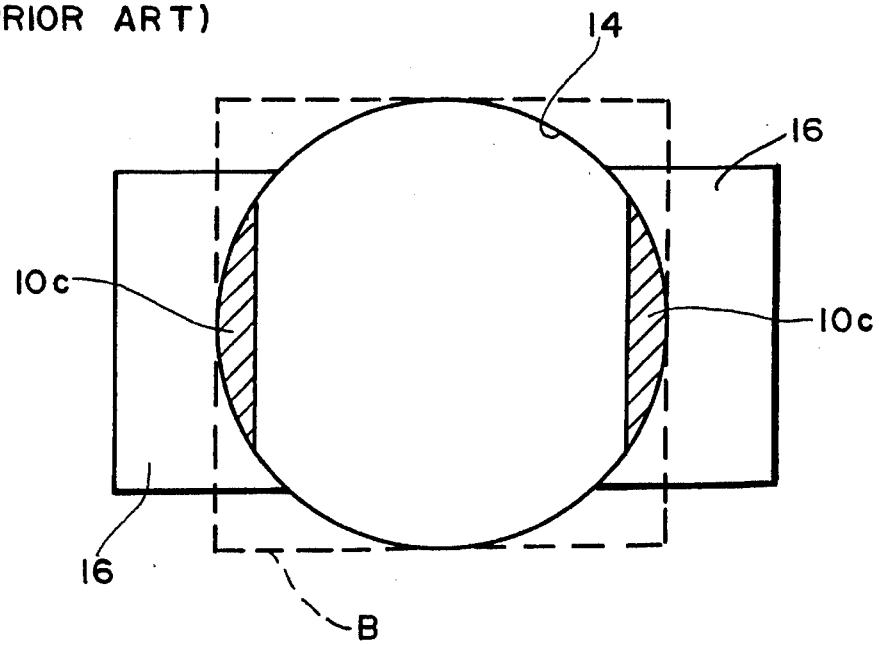
FIG. 2 (PRIOR ART)
FIG. 2 is a top plane view, in schematic, illustrating a design which substantially eliminates underdesired solder wicking with standard wave soldering machines.
Figure 3:
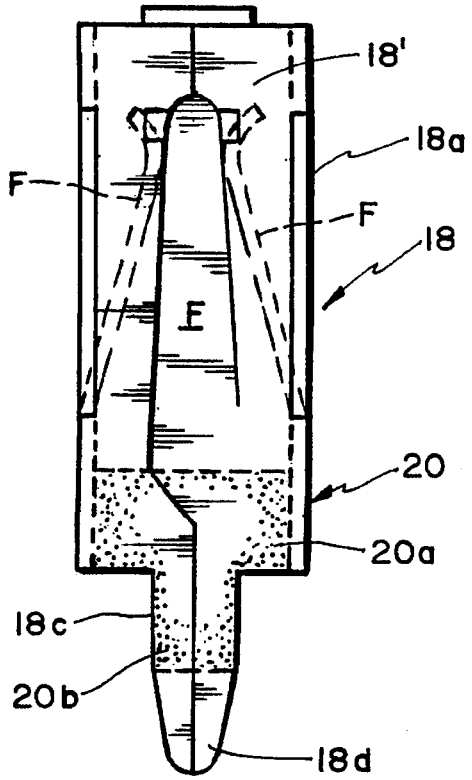
FIG. 3 is side elevational view of a box contact in accordance with the present invention, in cross-section to illustrate the solder-resistant tape adhesively attached to a surface of the contact exposed to solder during wave soldering.

Referring now specifically to the drawings, in which identical or similar reference parts are designated by the same reference numerals throughout, and first referring to FIG. 3, a box contact in accordance with the present invention is generally designated by the reference numeral 18.

The contact 18 has an upper contact portion 18*a* having a general uniform rectangular, typically square cross-section forming an interior space 18' which is open at the upper and lower ends of the contact portion 18*a*, as viewed in FIG. 3. The space 18' is dimensioned to receive a male contact member (not shown) through the upper open end. As is common with such box contacts, resilient to spring fingers F are formed from the sidewalls of the contact which protrude inwardly, best shown in FIG. 4. Mounting legs 18*c* are provided at the lower open end of the contact portion 18*a*, two mounting legs being shown which are spaced from each other and in opposing relationship. The mounting legs are spaced and dimensioned so as to be receivable through an opening in a printed circuit board in a conventional manner.

A solder-resistant tape 20 is adhesively attached to a surface of the contact portion 18*a* within the interior space 18' at least in the region of lower open end. Tape 20 is resistant to molten solder during soldering to thereby mask the interior surface and prevent solder from wicking into adhering to the interior surface of the contact to thereby block the lower open end of the contact portion. In the embodiment shown, the mounting legs 18*c* are not fully coated with the tape 20, a lower most portion 18*d* of the mounting legs being left uncovered. However, the tape includes an upper tape portion 20*a* that covers the lower surface of the contact portion 18*a* and 20*b* that covers the upper portion of the mounting leg 18*c*. It is important, in the use of the invention, to coat the inwardly facing surfaces of the box contact in the region of the lower open end thereof where the molten solder has a tendency to enter and solidify. The application of solder to the lower most tip 18*d* of the mounting leg does not present a serious problem and, in that instant, results in a saving of tape. It is, of course, possible to coat the entire mounting leg with tape and this would, in most instances, be the preferable approach.

The specific tape 20 that is used for the purpose of practicing the invention is not critical and almost any adhesive tape will provide the desired function. Numerous known tapes can be used for this purpose, including plastic tapes and paper tapes. In fact, inexpensive paper masking tapes have been found to have utility for this purpose. However, in most instances, better quality tapes are available and should be used. Such tapes include polyimide and polyester films or tapes. Many such tapes are provided with adhesive systems which include silicone and are designed to resist solder at high temperatures. One such tape is marketed under the mark "CAPTON" is distributed by Specialty Tapes of Racine, Wis. and designated as tape No. CW-2210. Another tape marketed as style No. C690 under the mark "Temp-R-Tape" is distributed by the CHR Division of Furon of New Haven, Conn. Numerous film and paper tapes are marketed by TTI Industrial Division of Tesa Tuck, Inc. of Sparta, Mich. suitable film tapes being distributed under Model No. 428 and 4429, both of which are polyimide tapes. Tesa Tuck, Inc. also distributes a film under the designation "Tesafilm 4164 (R)" which is designed for conventional masking during wave soldering. Numerous tapes suitable for the purpose are also marketed by Ideal Tape Company of Lowell, Mass. many of which are polyester, polyimide and even paper/polyester laminates that are suitable for the intended purpose and are coated with various adhesives, including silicone and rubber.

Figure 5:
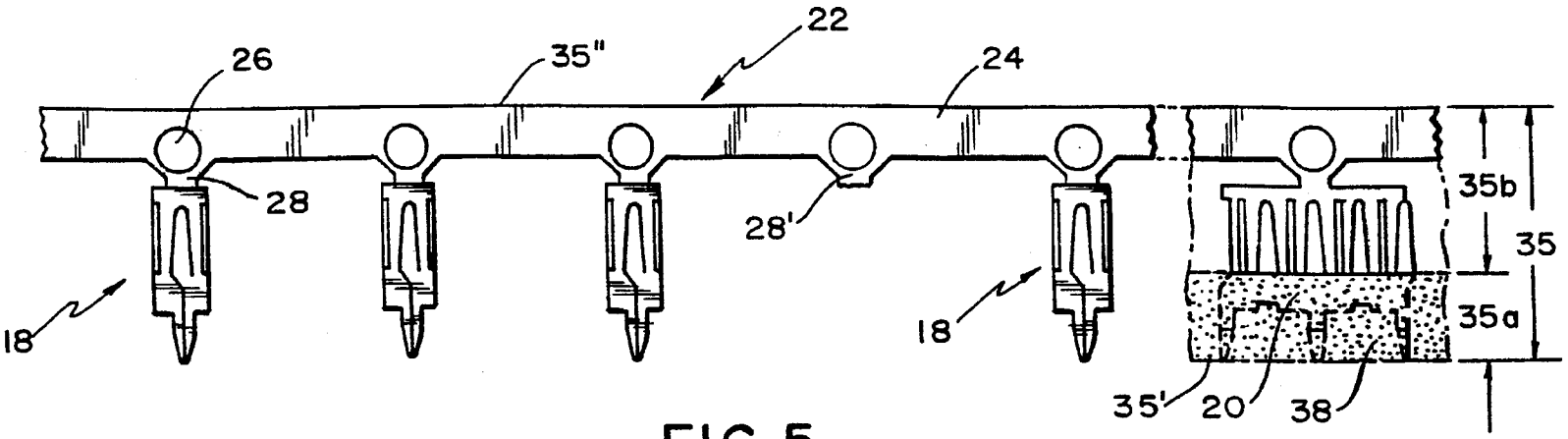
FIG. 5 is a schematic representation of a plurality of box contacts in accordance with the present invention mounted on a continuous carrier, and showing, in broken outline, the continuous strip with tape attached thereto prior to die cutting and forming.
Figure 6:
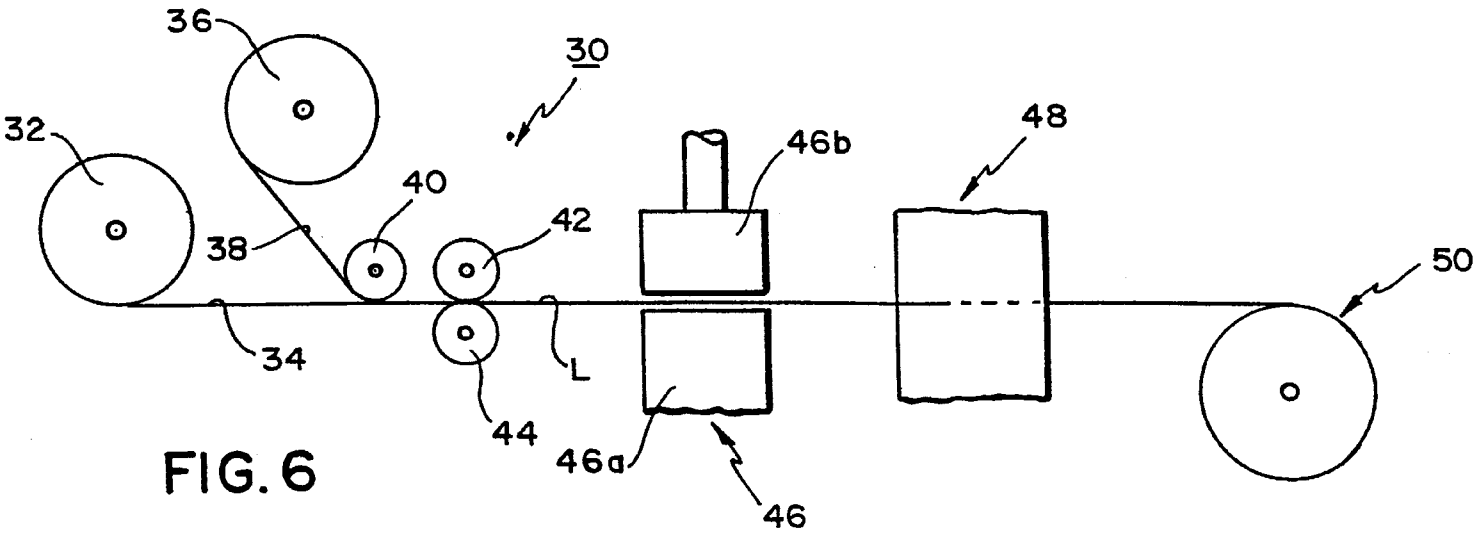
FIG. 6 is a schematic representation of the method of producing box contact in accordance with the present invention.

The method of manufacturing box contacts in accordance with the present invention, referring to FIGS. 5 and 6, comprises the steps of providing a reel 32 from which there is advanced a continuous strip of metallic material 34 along a predetermined path as shown. The strip of metallic material has a predetermined width 35 (FIG. 5) and provided with a solderable surface and defines first and second longitudinal edges 35' and 35" as shown. A second reel 36 is provided with a continuous strip of solder-resistant tape 38 which is advanced along the same predetermined path, being guided by roller 40 into proximity with the metallic strip 34, both the strips being superimposed or juxtaposed with each other. The solder-resistant tape 40 is provided with an adhesive on a side facing the strip of metallic material and the two strips are pressed against each other by means of pressure rollers 42, 44 to form a single laminated strip. The strip of tape 38 has a width 35*a* smaller than the width 35 of the metallic strip. The strip of tape 38 covers a first continuous longitudinal surface portion of the metallic strip proximate to the first longitudinal edge 35', the lower edge as viewed in FIG. 5, to thereby leave exposed a second continuous longitudinal surface portion having a width **35*b* proximate to the second longitudinal edge 35", the upper edge as viewed in FIG. 5. The left side of FIG. 5 shows, in fragmented view, a portion of the strip prior to die cutting and forming, with the outline of the contact showing the lines where the contact is die cut from the continuous laminated strip. As illustrated in FIG. 6, the laminated tape L is directed through a die cutting machine 46 which may have a fixed body 46*a* and an upper punch or die cutting tool 46*b* that is periodically urged downwardly to die cut the laminated strip to provide the desired blanks or outlines of the box contacts. However, instead of a reciprocating movable punch 46*b*, any die cutting equipment can be used, including a circular die cutting tool or other like die cutting tools well known to those skilled in the art. The die cutting of the laminated strips forms the continuous strip 22 that includes the upper portions of the box contacts detachably connected to the continuous carrier 24 at the untaped second longitudinal surface portion and the taped lower portions of the box contacts and mounting legs. In this way, the lower portions of the box contacts and the mounting legs are at least partially covered with the solder-resistant tape to prevent wicking into and blocking of the lower open ends of the box contacts. The unit 48 shown in FIG. 6 is the forming device for converting the two-dimensional blanks shown on the right of FIG. 5 into the three-dimensional box contacts shown on the left of FIG. 5. The box contacts are attached to the carrier 24 and advantageously accumulated on a takeup reel 50**.

Figure 4:
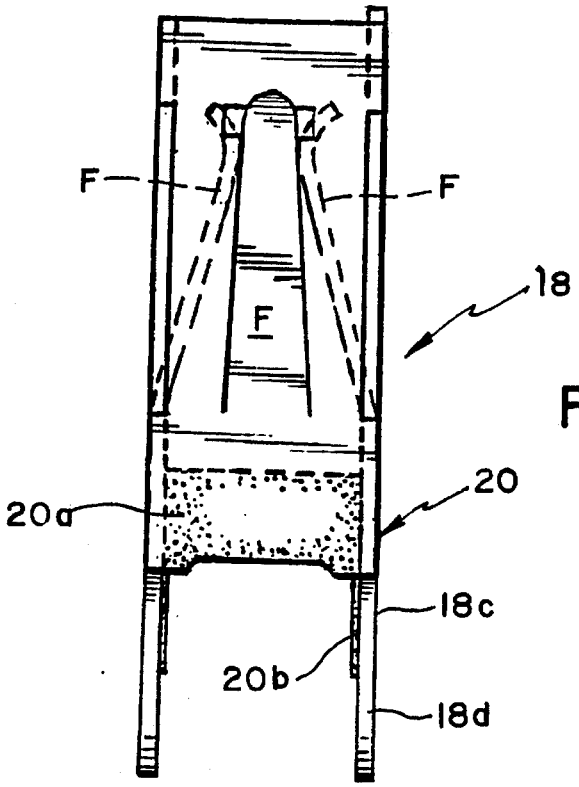
FIG. 4 is a front elevational view of the contact shown in FIG. 3.

In FIG. 5, a plurality of box contacts of the type shown in FIGS. 3 and 4 are shown integrally attached to a carrier strip 24 provided with sprocket holes 26 for use in connection with automated insertion equipment. Each of the contacts is connected to the carrier strip 24 by means of a frangible carrier tab 28 which is severed downstream by the insertion machine, as suggested at 28'.

With the introduction of solder-resistant tape at the lower ends of the box contacts and the upper ends of the mounting legs, to provide solder-resistant surfaces proximate to the lower open ends of the box contacts, an inexpensive method can now be employed to produce contacts that can be used with new turbulent wave soldering machines while maintaining the low cost of production of such contacts.

While there has been illustrated and described a preferred embodiment of the invention, it is understood that the invention is capable of modification and, therefore, the invention is not to be limited to the precise details set forth but the invention is intended only to be limited to the scope of the claims that follow.

We claim:

1. A method of manufacturing box contacts comprising the steps of advancing a continuous strip of metallic material along a predetermined path, said strip of metallic material having a predetermined width and provided with a solderable surface and defining first and second longitudinal edges; advancing a continuous strip of solder resistant tape along said predetermined path and juxtaposed with said strip of metallic material, said strip of tape having a width smaller than said predetermined width and provided with adhesive on a side facing said strip of metallic material; attaching said strip of tape to said metallic strip to cover a first continuous longitudinal surface portion of said metallic strip proximate to said first longitudinal edge to thereby leave exposed a second continuous longitudinal surface portion of said metallic strip proximate to said second longitudinal edge; die cutting and forming said attached strips to form upper portions of box contacts detachably connected to a continuous carrier strip formed from said second longitudinal surface portion and lower portions of box contacts and mounting legs for each box contact formed from said second continuous longitudinal surface portion, whereby said lower portions of the box contacts and mounting legs are at least partially covered with said solder resistant tape to prevent wicking into and blocking a lower open end of the box contact.

2. A method as defined in claim 1, wherein said step of adhesively attaching said strip includes the step of pressing said strips together.

* * * * *